United States Patent [19]

Taylor

[11] 4,098,307

[45] Jul. 4, 1978

[54] AUTOMATIC SHUT-OFF LIQUID DISPENSING NOZZLE

[75] Inventor: Clarence R. Taylor, Penfield, N.Y.

[73] Assignee: David M. Goodrich, Avoca, N.Y.

[21] Appl. No.: 749,050

[22] Filed: Dec. 9, 1976

[51] Int. Cl.[2] ..... B65B 57/14

[52] U.S. Cl. ..... 141/220; 137/614.21; 141/392

[58] Field of Search ..... 137/614.21; 141/46, 141/115, 116, 198–229, 286, 301, 309, 311 A, 379, 392

[56] References Cited

U.S. PATENT DOCUMENTS

| | | | |
|---|---|---|---|
| 1,689,066 | 10/1928 | Baxter | 141/220 |
| 2,124,295 | 5/1964 | Glasgow | 137/614.21 |
| 2,418,280 | 4/1947 | Steen | 141/220 |

*Primary Examiner*—Richard E. Aegerter
*Assistant Examiner*—Frederick R. Schmidt
*Attorney, Agent, or Firm*—Steve W. Gremban

[57] ABSTRACT

A nozzle adapted to be releasably secured to a container and through which liquid can be dispensed from the container into another receptacle when the nozzle is directed downwardly, i.e., in a liquid dispensing position. The nozzle contains a valve for automatically shutting off the flow of liquid from the container to the receptacle when the receptacle is substantially filled.

10 Claims, 7 Drawing Figures

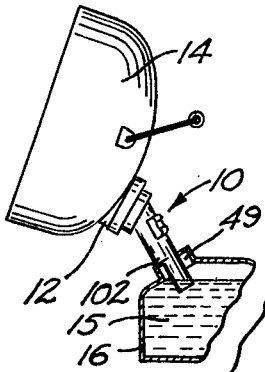
FIG. 1
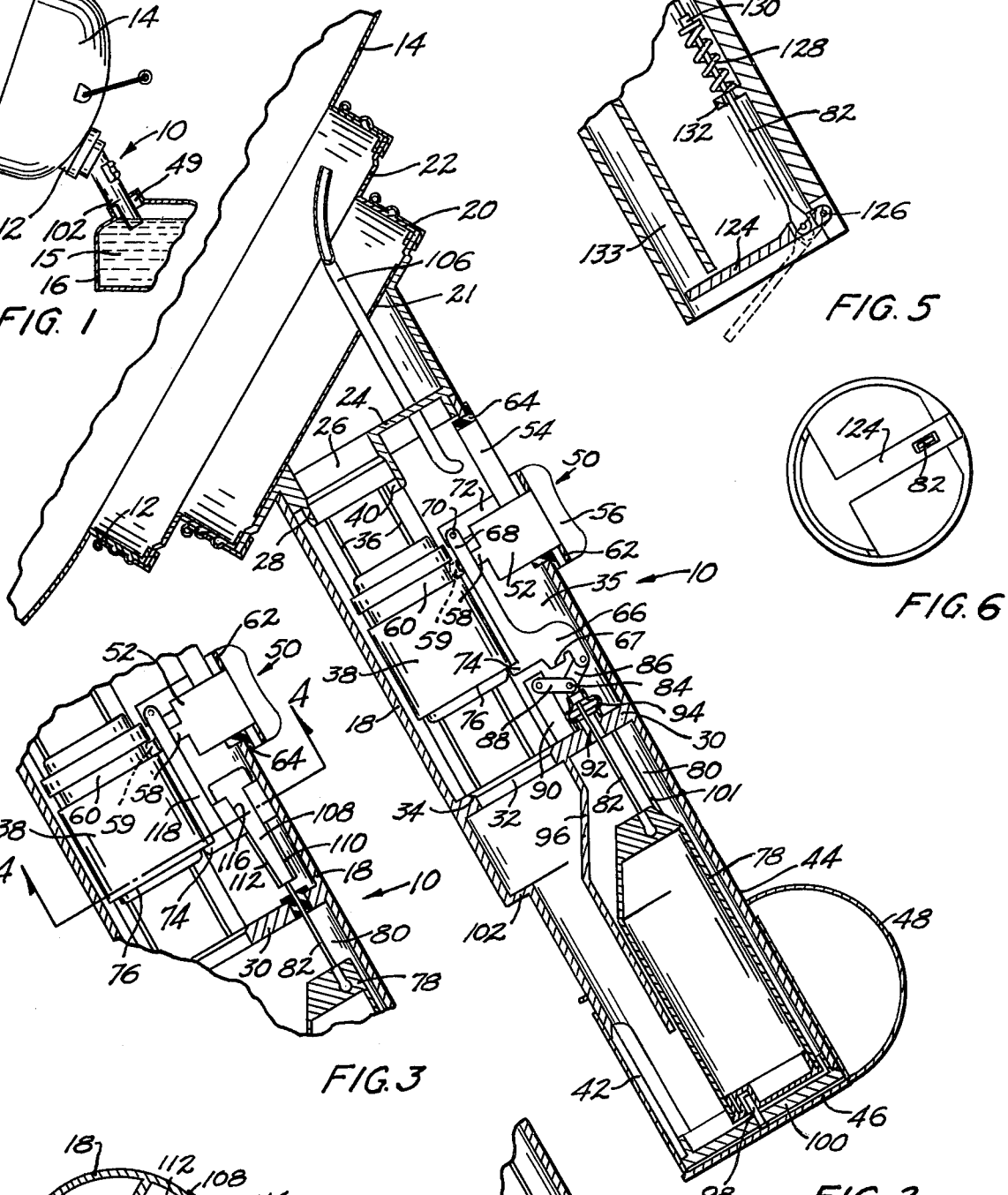
FIG. 2
FIG. 3
FIG. 5
FIG. 6
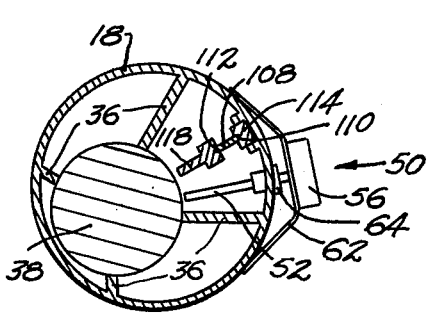
FIG. 4
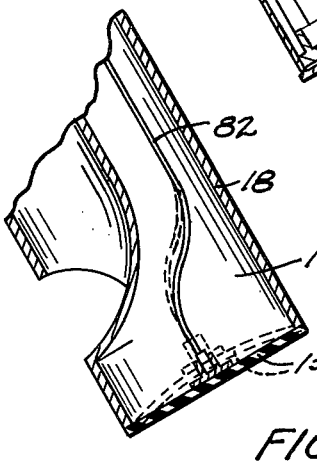
FIG. 7

AUTOMATIC SHUT-OFF LIQUID DISPENSING NOZZLE

BACKGROUND OF THE INVENTION

1. Field of the Invention

This invention relates generally to nozzles for containers or the like, and more specifically to an automatic shut-off liquid dispensing nozzle.

2. Description of the Prior Art

Automatic shut-off liquid dispensing nozzles are generally well known in the art of which U.S. Pats. Nos. 1,689,066, 2,420,341 and 2,582,195 are exemplary. One of the disadvantages of the nozzle disclosed in U.S. Pat. No. 1,689,066 is that the valve plate can be inadvertently left in its open position and some liquid may be dispensed through the nozzle if the container is tilted before the nozzle is inserted into the receptacle. Also once the valve plate latch is released by the rising liquid in a receptacle, the construction of the valve mechanism is such that it is questionable whether the liquid flow will generate sufficient force to move the valve plate into a valve closed position quickly enough to prevent overfilling the receptacle.

The automatic shutoff nozzles disclosed in U.S. Pat. Nos. 2,420,341 and 2,582,195 are of complicated design and construction containing many moving parts manufactured to close tolerances and hence are too expensive to manufacture for some applications.

Applicant's improved liquid dispensing nozzle is believed to obviate these and other disadvantages of the prior art nozzles.

SUMMARY OF THE INVENTION

In accordance with preferred embodiments of the invention, an automatic shut-off liquid dispensing nozzle is disclosed which is mountable on the orifice of a container. Liquid is dispensed from the container through the nozzle into a receptacle when the container is tilted with the nozzle directed downwardly in a liquid dispensing position. When the receptacle becomes substantially filled with liquid, novel valve means in the nozzle is responsive to the rising liquid to automatically shut off the flow of liquid through the nozzle into the receptacle, thereby preventing overfilling of the receptacle.

The nozzle defines a chamber having axially spaced inlet and outlet valve ports through which the liquid is dispensed from the container to the receptacle. The novel valve means comprises a valve piston mounted within the chamber for reciprocal movement between a normal first position for sealing the inlet valve port and preventing liquid flow into the chamber, a second position for sealing the outlet valve port and preventing further liquid flow out of the chamber, and an intermediate latched position between the inlet and outlet valve ports for allowing liquid flow from the container through the chamber and into the receptacle. The nozzle further has novel slide means for manually moving the valve piston between its normal first position and latched position. Novel latch means are provided for releasably latching the valve piston in the latched position. The nozzle further has a novel latch control means coupled to the latch means and movable in response to the rising liquid in the receptacle from a normal extended position in which it holds the latch means in its latched position to a retracted position for releasing the latch means when the receptacle is substantially filled with liquid. Following release of the valve piston by the latch means, the flow of liquid through the chamber forces the piston to its second position for immediately sealing the outlet valve port and shutting off any further liquid flow through the nozzle chamber.

In a more specific embodiment of the invention, the nozzle comprises a tube having an outer wall defining an elongated slot. The slide means comprises a slide member having a handle at one end, a middle portion extending through and slidable along the elongated slot and a projection at the opposite end engageable with a peripheral groove in the piston. A spring biases the slide member in a radial direction normally disengaging the projection from the groove.

The latch means comprises a pivotal latch lever having a finger adapted in the extended position of the latch control means to engage a shoulder on the piston for holding the piston in its intermediate latched position.

The latch control means comprises a float and a rod having one end connected to the float. The opposite end of the rod is pivotally connected to hingeably joined ends of a pair of toggle arms, the opposite end of one arm being pivotally connected to the latch lever and the opposite end of the other arm being pivotally connected to the tube.

The tube has a screw cap at one end adjacent the inlet valve port for releasably securing the nozzle to a container or the like. A dirt cap is provided on the opposite outlet end of the tube to prevent dirt from entering the tube.

In still another embodiment of the invention, the latch means comprises a reciprocally movable cam plate having a tapered cam surface. One end of the cam plate is connected to the float rod and the opposite end of the cam plate is engageable with the middle portion of the slide member. The latch lever is movable between latched and unlatched positions by an inclined cam follower surface engageable with the tapered cam surface of the cam plate.

In other modifications, the float of the latch control means is replaced by a rubber diaphragm at one end of a closed air and liquid tight chamber. In still another modification, the float is replaced by a hinged plate pivotally mounted at one end of the nozzle and biased by a spring and the rising liquid in the receptacle to a retracted position for releasing the latch means.

One of the advantages, among others, of the liquid dispensing nozzle of this invention is its simplicity of design and construction, its durability and reliability in operation and its economy of manufacture.

The invention and these and other advantages will become more apparent from the detailed description of the preferred embodiments presented below.

BRIEF DESCRIPTION OF THE DRAWING

In the detailed description of the preferred embodiments of the invention presented below, reference is made to the accompanying drawing, in which:

FIG. 1 is a side elevational view partially in section of the nozzle of this invention releasably secured to a container which is tilted to dispense liquid from the container into a receptacle;

FIG. 2 is an enlarged side elevational view in section of the nozzle of FIG. 1;

FIG. 3 is a segmental elevational view in section showing an alternative latch means for the nozzle;

FIG. 4 is a section view taken substantially along line 4—4 of FIG. 3;

FIG. 5 is a segmental view in section of a modification of a portion of the latch control means of the nozzle;

FIG. 6 is an end view of the latch control means of FIG. 5; and

FIG. 7 is a segmental elevation view in section showing still another modification of a portion of the latch control means for the nozzle.

DESCRIPTION OF THE PREFERRED EMBODIMENTS

With reference to FIG. 1, a preferred embodiment of the liquid dispensing nozzle 10 of this invention is illustrated releasably secured to an orifice 12 of a container 14. The container is tilted for dispensing liquid 15 therefrom through nozzle 10 into a receptacle 16. The nozzle 10 is designed to automatically shut off the flow of liquid 15 from container 14 into receptacle 16 when the receptacle is substantially filled with liquid.

With reference to FIGS. 1 and 2 primarily, the nozzle 10 of this invention comprises a conduit such as a tube 18 having a screw cap 20 at one end by which the nozzle may be releasably secured to threaded orifice 12 on container 14 or to an adapter 22 which is threadable onto the container orifice 12. A screen 12 is suitably fastened to nozzle 10 to filter out sediment from liquid being poured. The tube 18 has a transverse plate 24 adjacent the screw cap end which is provided with an inlet valve port 26 defining an inlet valve seat 28. Substantially intermediate the ends of tube 18 is another transverse plate 30 having an outlet valve port 32 defining an outlet valve seat 34 and cooperating with plate 24 to form a chamber 35. The tube is provided with a plurality of rails 36 as seen best in FIGS. 2 and 4 axially extending from inlet port 26 to outlet port 32, the rails 36 further extending substantially radially inwardly from the inner periphery of tube 18, the free ends thereof forming a cylinder within which a valve piston 38 made up of one or more suitable materials is reciprocally moved.

The valve piston is movable between a normal first position, a second position, and an intermediate latched position. In the normal first position, one end of piston 38 is manually forced by slide means to be described hereinafter to seat within inlet valve seat 28 to prevent any liquid flow from container 14 into nozzle 10. Piston 38 is releasably held in this first position by the tight fit between the piston end and inlet valve seat 28 and by a resilient lip 40 projecting from the inlet valve seat. Lip 40 serves to prevent immediate sealing of piston 38 in valve seat 28 when container 14 is set down in a normal horizontal position, nozzle 10 tilted upwardly, following a receptacle filling operation, thereby allowing liquid in piston chamber 35 to drain back into container 14. In the second position, the other end of piston 38 seats within outlet valve seat 34 for preventing liquid flow out of piston chamber 35. In the intermediate latched position as seen in FIGS. 2 and 3 the inlet and outlet ports 26, 32 respectively are open and liquid is free to flow from container 14 through inlet port 26, piston chamber 35, outlet port 32 and an outlet opening 42 in tube outlet 44 (assuming a dirt cap 46 has been removed) into receptacle 16. The dirt cap 46 is cup-shaped and has a handle 48 to facilitate removing and attaching the cap to tube outlet 44 to prevent dirt or the like from entering nozzle 10 or liquid to flow out of the nozzle in the event piston 38 is inadvertently left in its intermediate latched position as seen in FIG. 2.

The nozzle 10 is provided with slide means for manually moving piston 38 to its normal first position prior to or following the completion of a receptacle liquid filling operation. The slide means further serves to manually move piston 38 out of its normal first position for movement by the slide means, liquid flow and gravity to its intermediate position preferably after the nozzle is inserted in the receptacle orifice 40 to commence a filling operation. The slide means comprises a slide member 50 having a middle portion 52 extending through an elongated slot 54 in tube 18 for slidably guiding slide member 50, a handle 56 at one end by which the slide member may be manually moved along slot 54 for moving the piston 10 between its first and latched positions, and a projection 58 at the opposite end of slide member 50. The projection 58 is extendable into a peripheral groove 60 in piston 38, as shown by dotted lines at 59, when slide member 50 is manually pressed radially inwardly at either the first or intermediate positions into a piston engaged condition from its normal piston disengaged condition. A spring 62 is interposed between handle 56 and tube 18 for returning and retaining the slide member in its normal piston disengaged condition in which projection 58 is removed from piston groove 60 and piston 38 is free to slide along guide rails 36. The tube slot 54 is preferably provided with any suitable resilient seal means 64 to prevent liquid leakage out of chamber 35 through slot 54.

A latch means comprising a pivotally mounted latch lever 66 is provided for releasably holding piston 38 in its latched position when the latch lever is latched as seen in FIGS. 2 and 3. The latch lever 66 has one end 68 pivotally connected by pin 70 to a support flange 72 on tube 18. Latch lever 66 further has a radially inwardly extending finger 74 at the opposite end adapted in the latched position to engage a shoulder 76 on piston 38 for releasably holding the piston in its intermediate latched position.

A latch control means is provided for achieving the dual functions of (1) moving latch lever 66 to its latched position and releasably holding it in that position when the latch control means is in its normal extended position, and (2) releasing latch lever 66 and piston 38 to stop liquid flow through the nozzle when the latch control means is in its retracted position. The latch control means comprises a hollow liquid and air tight float 78 located in a float chamber 80 and secured by a snap detent to one end of a rod 82. The opposite end of rod 82 is hingeably connected by a pin 84 to the ends of a pair of toggle arms 86, 88. The opposite end of arm 86 is pivotally connected to latch lever 66 and the opposite end of arm 88 is pivotally connected to a tube support flange 90. FIGS. 2 and 3 show latch levers 66, 118 in their normal latched positions due to the weight of float 28 when the nozzle is pointed downwardly as shown. Movement of float 78 upwardly (due to the rising liquid in receptacle 16 when the receptacle is substantially filled) causes toggle arms 86, 88 to straighten out pivoting latch lever 66 radially outwardly to its unlatched position withdrawing finger 74 from piston shoulder 76. Protuberance 67 on latch lever 66 prevents overtravel of toggle arms 86 and 88. The released piston 38 is forced by the flowing liquid into sealing engagement with outlet valve seat 34 shutting off further liquid flow through the nozzle.

The float rod 82 passes through an opening 92 in plate 30, and a seal means 94 of any suitable type is provided between rod 82 and opening 92 to prevent liquid flow into float chamber 80. A curved shield 96 of the float chamber has one end secured to plate 30 for shielding float 78 from liquid flowing through nozzle outlet 42 which might otherwise interfere with the operation of the float. The float 78 is guided for vertical movement with the surfaces thereof out of engagement with the walls of float chamber 80 by a pin 98 having one end secured to nozzle end 100 and its opposite end seated within an opening in the float. Alternatively, elongated radial rails 101 similar to rails 36 could be provided for guiding the float for vertical movement with minimal frictional contact with the walls of float chamber 80. The nozzle 10 has a shoulder 102 adjacent outlet end 42 for engaging the end of receptacle orifice 49 (FIG.1) and supporting container 14 in its liquid dispensing position. The shoulder 102 further limits the length of nozzle inserted into orifice 49. The nozzle is further provided with an air tube 106 extending through and supported by plate 24 for allowing air to enter container 14 and prevent the formation of a vacuum therein as the liquid is dispensed therefrom.

In the modification of the invention illustrated in FIGS. 3 and 4, parts similar to parts described in FIG. 2 will be denoted by the same numerals. The latch control means comprises a cam plate 108 having opposed knife edges 110, 112. Edge 110 is parallel to tube 18 and edge 112 is tapered, both edges being slidable within complementary V-shaped grooves in a tube insert 114 and cam follower surface 116 respectively, the latter on a latch lever 118. Cam plate 108 is secured to float rod 82 which in turn is fastened to float 78 by a snap detent. When float 78 is raised by the rising liquid, cam plate 108 is moved upwardly to release latch lever 118.

FIGS. 5 and 6 disclose an alternative mechanism for the float 78 of the latch control means in which parts similar to parts described in FIG. 2 will be denoted by the same numerals. A T-shaped plate 124 is provided having one end pivotally secured to tube 18 at 126. One end of float rod 82 is pivotally secured to plate 124 adjacent pivot 126, and a spring 128 is interposed between a collar 130 on rod 82 and a tube flange 132 through which the rod extends for biasing plate 124 toward the full line position shown in FIG. 5 for releasing the latch. The weight of plate 124 and the pressure of liquid flowing through channel 133 acting on the plate in the liquid dispensing position illustrated is sufficient to overcome spring 128 and latch piston 38 in its intermediate position. When the receptacle 16 is substantially filled, the pressure of the flowing liquid is absorbed instead by the rising liquid. Spring 128 is then sufficient to move plate 124 to its full line position for releasing the latch and piston. The flowing liquid forces piston 38 to seat in outlet valve seat 34 and shut off any further liquid flow through nozzle 10.

In FIG. 7 still another mechanism is disclosed for replacing float 78 of the latch control means and parts similar to parts described heretofore are denoted by the same materials. The mechanism comprises a liquid and air tight chamber 134 sealed off at the lower end by one or more flexible diaphragms 136 such as a rubber diaphragm. One end of rod 82 is secured by a snap fit detent to the center of diaphragm 136 and the opposite end extends through a seal 94 in chamber 80 and is secured to toggle arms 84, 88 of the latch control means.

The invention has been described in detail with particular reference to preferred embodiments, but it will be understood that variations and modifications can be effected within the spirit and scope of the invention as described hereinabove.

What is claimed is:

1. An automatic shut-off dispensing nozzle comprising:

a conduit defining a chamber having axially spaced inlet and outlet valve ports through which a liquid can be dispensed into a receptacle when the nozzle is tilted downwardly into a liquid dispensing position;

a freely sliding valve piston reciprocally movable within said chamber between a normal first position for sealing said inlet valve port and preventing liquid flow into said chamber, a second position for sealing said outlet valve port and preventing liquid flow out of said chamber, and an intermediate latched position between said inlet and outlet valve ports for allowing liquid flow through said inlet and outlet valve ports of said chamber into the receptacle;

slide means manually movable into engagement with said valve piston for moving said valve piston into and out of said normal first position;

latch means for releasably holding said valve piston in said latched position when said valve piston has been moved by said slide means, liquid flow and gravity out of said normal first position and into said latched position while said nozzle is tilted downwardly into said liquid dispensing position; and latch control means coupled to said latch means and movable in response to the rising liquid in the receptacle from a normal extended position to a retracted position for releasing said latch means when the liquid has reached a predetermined level whereupon said valve piston is moved by the liquid being poured through said chamber to said second position for sealing said outlet valve port and shutting off the liquid flow through the chamber.

2. The dispensing nozzle according to claim 1 wherein said conduit has an outer wall defining an elongated slot, and said slide means comprises a slide member having a handle at one end, a middle portion extending through and slideable in said elongated slot, and a projection at the opposite end engageable with said valve piston.

3. The dispensing nozzle according to claim 2 wherein said valve piston has a groove, and said slide means comprises a spring for biasing said slide member in a direction normally disengaging said projection from said groove.

4. The dispensing nozzle according to claim 1 wherein said valve piston has a shoulder, and said latch means comprises a pivotal latch lever having a finger adapted in said normal extended position of said latch control means to engage said shoulder on said valve piston for holding said piston in its latched position.

5. The dispensing nozzle according to claim 4 wherein said latch control means comprises a float and a rod having one end connected to said float, and said latch means further comprises a toggle mechanism having a first arm with one end pivotally connected to said latch lever, a second arm having one end pivotally connected to said conduit, and the opposite ends of said rod is hingeably connected to the opposite ends of said first and second arms.

6. The dispensing nozzle of claim 4 wherein said latch control means comprises a float and a rod having one end connected to said float, and a reciprocally movable cam plate having a tapered cam surface and one end of said cam plate connected to the opposite end of said rod, and said latch lever has a cam follower surface engageable by said tapered cam surface when the nozzle is in its liquid dispensing position.

7. The dispensing nozzle according to claim 1 wherein said conduit has a lip adjacent said inlet valve port for preventing said piston from closing said inlet port under its own weight so that liquid in said chamber can drain out through said inlet seat when the nozzle is tilted upwardly, said lip further assisting in holding said valve piston in its normal first position for sealing said inlet valve port when said valve piston is moved by said slide means into said first position.

8. The dispensing nozzle according to claim 1 wherein said conduit comprises a tube having an outer wall defining an elongated slot; said valve piston has a shoulder and a groove; said slide means comprises a slide member having a handle at one end, a middle portion extending through and slideable in said elongated slot, a projection at the opposite end engageable with said piston groove, and a spring for biasing said slide member in a direction normally disengaging said projection from said groove; said latch means comprises a pivotal latch lever having a finger adapted in said normal extended position of said latch control means to engage said shoulder on said piston for holding said piston in its latched position; and said latch control means comprises a toggle mechanism comprising a first arm having one end pivotally connected to said latch lever, and a second arm having one end pivotally connected to said tube, a float, and a rod having one end connected to said float and the opposite end of said rod hingeably connected to the opposite ends of said first and second arms.

9. The dispensing nozzle of claim 8 and further comprising a screw cap at one end of said tube adjacent said inlet valve seat for releasably securing the nozzle to a container or the like.

10. The dispensing nozzle of claim 9 and further comprising a dirt cap on the opposite end of said tube to prevent dirt from entering said tube.

* * * * *